US006719277B2

(12) United States Patent
Ohanesian

(10) Patent No.: US 6,719,277 B2
(45) Date of Patent: Apr. 13, 2004

(54) THERMOFORMED WALL AND FENCING ASSEMBLIES

(76) Inventor: Viken Ohanesian, 26 Pacific Crest, Laguna Niguel, CA (US) 92677

( * ) Notice: Subject to any disclaimer, the term of this patent is extended or adjusted under 35 U.S.C. 154(b) by 0 days.

(21) Appl. No.: 09/928,153

(22) Filed: Aug. 10, 2001

(65) Prior Publication Data

US 2003/0030047 A1 Feb. 13, 2003

(51) Int. Cl.[7] ..... E04H 17/14
(52) U.S. Cl. ..... 256/19; 256/24
(58) Field of Search ..... 256/19, 24, 25, 256/26, 65.01, 65.02, 65.03, 65.04, 65.06, 73; 52/585.1; D25/38, 40, 42, 163

(56) References Cited

U.S. PATENT DOCUMENTS

| | | | | | |
|---|---|---|---|---|---|
| 968,908 | A | * | 8/1910 | Williamson | 256/19 |
| D69,391 | S | * | 2/1926 | Grundlock | D25/42 X |
| D184,982 | S | * | 4/1959 | Carlson | D25/42 |
| 2,919,112 | A | * | 12/1959 | Cofield | 256/65.02 X |
| 2,956,705 | A | | 10/1960 | Clingman | |
| D200,313 | S | | 2/1965 | Monroe | |
| D214,559 | S | | 7/1969 | Tacke | |
| 3,902,703 | A | * | 9/1975 | Bouye | 256/19 X |
| 4,938,445 | A | * | 7/1990 | Medley | 256/65.06 X |
| 5,100,107 | A | * | 3/1992 | Latta | 256/19 |
| 5,237,790 | A | | 8/1993 | Smalley | |
| 5,647,181 | A | | 7/1997 | Hunts | |
| 5,725,201 | A | * | 3/1998 | Parth | 256/24 |
| 5,857,664 | A | | 1/1999 | Schauman | |
| 5,864,997 | A | | 2/1999 | Kelly | |
| D453,045 | S | | 1/2002 | Ohanesian | |
| D453,577 | S | | 2/2002 | Ohanesian | |
| D453,847 | S | * | 2/2002 | Ohanesian | D25/163 |
| D455,219 | S | | 4/2002 | Ohanesian | |
| D458,390 | S | | 6/2002 | Ohanesian | |
| 6,601,831 | B2 | * | 8/2003 | Erwin | 256/19 X |
| 6,637,728 | B2 | * | 10/2003 | Pettit et al. | 256/19 |

FOREIGN PATENT DOCUMENTS

| | | | | |
|---|---|---|---|---|
| CA | 889055 | * | 12/1971 | 256/19 |
| FR | 2 481 357 | * | 10/1981 | 256/59 |

OTHER PUBLICATIONS

Sweet's General Building & Renovation 1995 Catalog File, vol. 1, New York, McGraw–Hill, Inc., Mar. 1995, sections 2830/BUF & 2830/MAS, TH455.S87.*

* cited by examiner

*Primary Examiner*—Greg Binda
(74) *Attorney, Agent, or Firm*—Myers Dawes Andras & Sherman LLP; Vic Y. Lin, Esq.; Joseph C. Andras, Esq.

(57) ABSTRACT

Plastic panels are thermoformed to include a variety of three-dimensional features resembling masonry patterns, various types of walls, and fencing sections. The thermoformed panels are incorporated into fencing and wall assemblies. A fencing assembly includes plastic panels thermoformed to resemble a plurality of stakes. Panels are disposed between a pair of posts with side portions configured to overlap. Each stake includes a top return projecting rearwardly. Horizontal reinforcements couple the panels to the posts. A double-sided wall assembly employs plastic panels thermoformed to resemble bricks and other wall patterns. Each sub-assembly includes a pair of panels coupled to a frame in a back-to-back arrangement. The sub-assemblies are disposed side-by-side in between a pair of posts.

20 Claims, 8 Drawing Sheets

10
45
74
72
70
30
76

10
3
Y
4
25
36
6
6
38
30
21
X
X
5
5
67
70
72
Y
32
34
27
3
4

10

10

10
45
74
72
70
30
76

THERMOFORMED WALL AND FENCING ASSEMBLIES

BACKGROUND OF THE INVENTION

1. Field of the Invention

The present invention relates generally to thermoplastic fencing, wall and building structures.

2. Description of Prior Art and Related Information

Until recently, fences have typically been composed of wood or metal. Wooden fences include several drawbacks. Such fences are susceptible to a great deal of wear and tear caused by natural elements, such as heat, wind and rain. The cost of the wood itself can be quite high, especially if a fence needs to be replaced. Corrugated metallic fences include several drawbacks as well. Not only is the metal subject to corrosion, but metallic fence sheets lack rigidity and dent easily. In addition to the susceptibility to deterioration, metallic fences tend to present a flimsy and cheap appearance.

As an alternative to wood fences, thermoplastic fencing assemblies have been provided with components formed to resemble wood fencing structures. Such thermoplastic assemblies include extruded, hollow tubes shaped to resemble planks. The "planks" are joined by horizontal "rails" and coupled to posts, all of which also consist of plastic, extruded tubes. Though such thermoplastic assemblies do not deteriorate in the same manner as does wood, the plastic fences of the prior art have their own disadvantages.

With respect to cost, the prior art assemblies include "planks" that are individually extruded. In particular, each plank consists of a separately extruded tube. As extruded tubes with hollow cores and open ends, caps are required to cover at least the tops of each tube in order to preserve aesthetics. Having to extrude each plank separately, however, leads to high costs. Each plank must then be secured to one or more horizontal rails, which increases costs and complexities related to assembly.

A further disadvantage of existing plastic fences includes the inability to withstand heat. Fences are generally provided for the outdoors where they are subject to the sun. In prior art plastic fences, each individual plank is extruded as a hollow tube, with a thin layer of plastic material. If the tubes are dark colored, a greater amount of heat from the sun is absorbed and captured within their hollow cores. The heat absorption exacerbated by dark colored tubes causes the thin tubes to deform.

SUMMARY OF THE INVENTION

The present invention provides structures and methods which overcome the deficiencies in the prior art.

In one aspect, a fence assembly is provided. The fence assembly comprises a thermoformed panel, a reinforcement coupled to the panel, and a post coupled to the panel. The thermoformed panel comprises a top, a bottom, a first axis defined between the top and the bottom, a plurality of stakes, with each stake extending parallel to the first axis and having a top return extending perpendicular to the first axis, and a nestable side portion. Each rearwardly projecting top return comprises a rounded curved shape. Each stake comprises a major portion and a minor portion that meet at a forwardly protruding ridge.

The assembly further comprises a side cover coupled to a side portion of the panel and a bottom flange. The reinforcement comprises a hollow bar and a solid insert disposed within the bar. The assembly further comprises a flat vertical portion disposed between each stake, wherein the reinforcement is welded to the flat vertical portions.

In another aspect, a fence assembly comprises a first post, a second post, a first thermoformed panel having a first plurality of vertically extending stakes with top returns, and a first side portion, and a second thermoformed panel having a second plurality of vertically extending stakes with top returns, and a second side portion configured to overlap the first side portion of the first thermoformed panel. The first thermoformed panel is disposed side-by-side with the second thermoformed panel such that the second side portion overlaps the first side portion. The first thermoformed panel and the second thermoformed panel are disposed in between the posts. The first thermoformed panel is coupled to the first post, and the second thermoformed panel is coupled to the second post. The assembly further comprises horizontal reinforcements coupled to the panels. The first side portion comprises a first laterally extending flange. The second side portion comprises a forwardly extending flange connected to a second laterally extending flange.

A double-sided wall structure is also provided. The structure comprises a frame having a first side and an opposite second side, a first thermoformed panel coupled to the first side of the frame, and a second thermoformed panel coupled to the second side of the frame. The first thermoformed panel comprises a first three-dimensional, non-extrudable front surface and a first rear surface substantially parallel to the first front surface. The second thermoformed panel comprises a second three-dimensional, non-extrudable front surface and a second rear surface substantially parallel to the second front surface. The frame comprises at least a top horizontal beam, a bottom horizontal beam, a first vertical beam and a second vertical beam.

The structure further comprises a support bar coupled to the top horizontal beam of the frame and a support bar coupled to the bottom horizontal beam of the frame. Side covers are coupled to at least a portion of the structure perimeter, namely to first and second sides of the structure. A post is coupled to the frame. The first rear surface comprises a first plurality of flat sections. The second rear surface comprises a second plurality of flat sections. The frame is coupled to the first and second plurality of flat sections.

In a further aspect, a double-sided wall assembly comprises a first sub-assembly, a second sub-assembly, a first post, and a second post. The first sub-assembly comprises a first frame, and a first pair of thermoformed panels coupled to opposite sides of the first frame. Each of the first pair of thermoformed panels has a front surface and a rear surface. The panels of the first pair are coupled to the first frame in a back-to-back configuration. The second sub-assembly comprises a second frame, and a second pair of thermoformed panels coupled to opposite sides of the second frame. Each of the second pair of thermoformed panels has a front surface and a rear surface. The panels of the second pair are coupled to the second frame in a back-to-back configuration. The first sub-assembly and the second sub-assembly are disposed side-by-side and in between the posts.

The assembly further comprises a first pair of brackets coupling the first sub-assembly to the first post, and a second pair of brackets coupling the second sub-assembly to the second post. The assembly further comprises a first, upper support bar and a second, lower support bar juxtaposed in an overlapping relationship with the first frame and second frame. A top cover and a bottom cover are disposed over the first sub-assembly and the second sub-assembly.

A method for manufacturing a fencing assembly is provided. The method comprises the steps of thermoforming a panel to form a three-dimensional front surface and a rear surface substantially parallel to the front surface, providing a thermoplastic post, and coupling a reinforcement to a rear surface of the panel. The step of thermoforming a panel comprises the step of forming a plurality of stakes and returns. The step of providing a thermoplastic post comprises the steps of extruding a hollow tube and injection molding a cap. The step of coupling a reinforcement to a rear surface of the panel comprises the step of adhering the reinforcement to the rear surface of the panel.

A method for assembling a plastic fence comprises the steps of coupling a first thermoformed panel to a first post, disposing a second thermoformed panel adjacent to the first thermoformed panel, overlapping a first side portion of the first thermoformed panel with a second side portion of the second thermoformed panel, removing a portion of the second thermoformed panel to leave a cut-off edge, covering the cut-off edge of the second thermoformed panel with a side cover, and coupling the second thermoformed panel to a second post.

A method for manufacturing a double-sided wall assembly comprising the steps of thermoforming a first panel to form a first three-dimension front surface and a substantially parallel first rear surface, thermoforming a second panel to form a second three-dimension front surface and a substantially parallel second rear surface, and forming a frame with a first side and a second side. The step of thermoforming the first panel comprises the step of forming the first panel with a first plurality of flat portions. The step of thermoforming the second panel comprises the step of forming the second panel with a second plurality of flat portions. The step of forming the frame comprises the step of providing horizontal bars and vertical bars configured to abut the first plurality of flat portions and the second plurality of flat portions. The step of thermoforming the first panel comprises the step of forming the first panel with a first plurality of flat portions. The step of thermoforming the second panel comprises the step of forming the second panel with a second plurality of flat portions.

A method for assembling a double-sided wall assembly is provided as well. The method comprises the steps of coupling a first pair of thermoformed panels to a first frame in a back-to-back configuration to form a first sub-assembly, coupling a second pair of thermoformed panels to a second frame in a back-to-back configuration to form a second sub-assembly, placing the first sub-assembly side-by-side with the second sub-assembly, coupling the first sub-assembly to a first post, and coupling the second sub-assembly to a second post. The method further comprises the steps of removing a portion of the second sub-assembly to expose a cut-off edge, and covering the cut-off edge with a side cover. A vertical support may be coupled to the cut-off edge of the second sub-assembly. The step of covering the cut-off edge of the second sub-assembly with a side cover comprises the step of covering the vertical support.

In summary, plastic panels are thermoformed to include a variety of three-dimensional features resembling masonry patterns, various types of walls, and fencing sections. The thermoformed panels are incorporated into fencing and wall assemblies. A fencing assembly includes plastic panels thermoformed to resemble a plurality of stakes. Panels are disposed between a pair of posts with side portions configured to overlap. Each stake includes a top return projecting rearwardly. Horizontal reinforcements couple the panels to the posts. A double-sided wall assembly employs plastic panels thermoformed to resemble bricks and other wall patterns. Each sub-assembly includes a pair of panels coupled to a frame in a back-to-back arrangement. The sub-assemblies are disposed side-by-side in between a pair of posts.

The invention, now having been briefly summarized, may be better appreciated by the following detailed description.

DETAILED DESCRIPTION OF THE PREFERRED EMBODIMENTS

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

Figure 1:
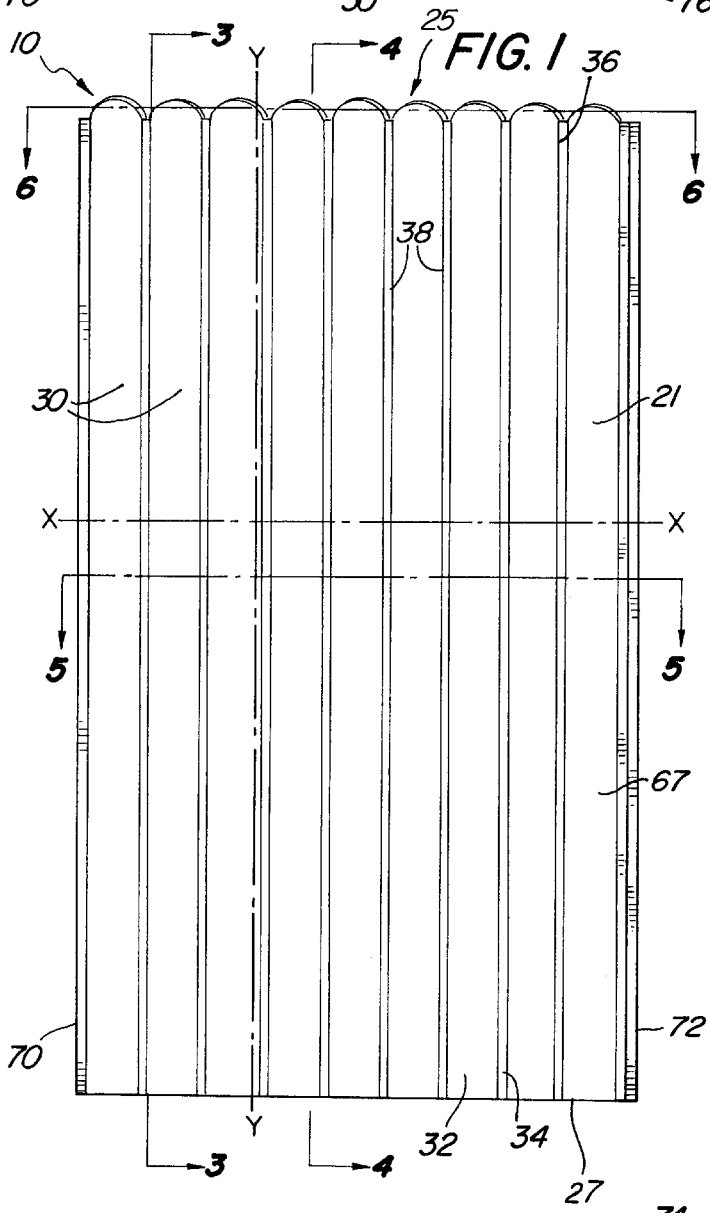
FIG. 1 is a front elevation view of a preferred embodiment of a fence panel according to the invention.
Figure 2:
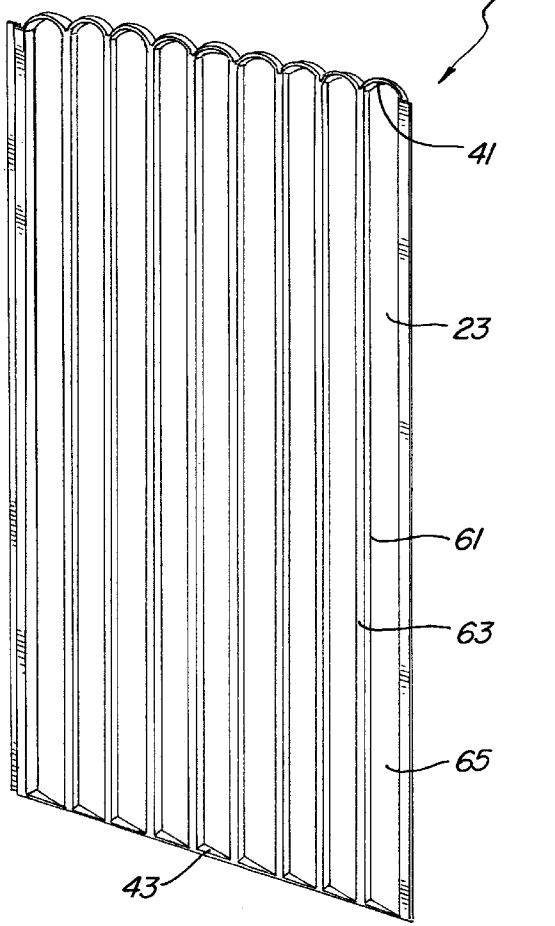
FIG. 2 is a rear perspective view of the preferred embodiment of the fence panel.

In a first preferred embodiment shown in FIGS. 1 and 2, a wall panel 10 is thermoformed into an integral, thermoplastic fence section resembling a plurality of stakes, or planks, 30 grouped together. A Y axis is defined between a top 25 and a bottom 27 of the panel 10. The stakes 30 thus extend vertically and substantially parallel to the Y-axis. Since the fence section 10 is preferably composed of a thermoplastic material, such as polyvinyl chloride (PVC), the thickness of the wall of the section 10 is roughly 0.05 inch to 0.15 inch. The panel 10 comprises an external, or front, surface 21 and an opposite internal, or rear, surface 23. Each "stake" 30 comprises a majority section 32 and a minority section 34 that meet at an outward ridge 36 and extend rearwardly therefrom to creases 38. The sections 32, 34, ridges 36, and creases 38 are preferably vertically extending. The stakes 30 are preferably identical with one another to allow for nesting as will be described further below.

Since the panel 10 is thermoformed and relatively thin, the front surface 21 is substantially parallel to the rear surface 23. Thus, each front ridge 36 on the front surface 21 shown in FIG. 1 corresponds to a rear crease 61 defined in the opposite rear surface 23 while a front crease 38 corresponds to a rear ridge 63. Each stake 30 includes a rearwardly projecting flange, or top return, 41. In the preferred embodiment, each top return 41 is rounded to form a "dog ear" design which may be perceived as a more desirable design. The returns 41 not only give the appearance of three-dimensional depth, but also provide extra rigidity. Similarly, the wall panel 10 includes a rearwardly projecting bottom flange 43 that provides additional strength. In particular, the top returns 41 and bottom flange 43 prevent the panel 10 from buckling along the vertical ridges 36 and creases 38. Each stake 30 includes a rear recess 65 defined by the vertical sections 32, 34, top return 41 and bottom flange 43.

It will be appreciated that the thermoforming process enables a panel to be formed with structural features, such as flanges and returns, which extend in a direction that is discontinuous with the remainder of the panel, such as the vertical sections. In the conventional extrusion process, an extruded body maintains a constant cross-section, or profile, throughout the axial length of the body. An extruded panel, therefore, may only be formed with linear, continuous sections that extend parallel to the axis defined by an extrusion die. Thermoforming, on the other hand, enables a panel to have "non-extrudable" structural features, including three-dimensional discontinuous texture, that is simply impossible to accomplish with extrusion. Thus, a thermoformed panel may have an irregular or variable profile along any axis of the panel.

Figure 6:
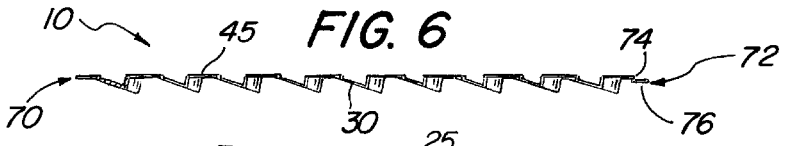
FIG. 6 is a cross-sectional view of the preferred fence panel taken along lines 6—6 of FIG. 1.
Figure 3:
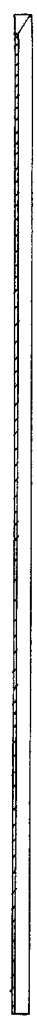
FIG. 3 is a cross-sectional view of the preferred fence panel taken along lines 3—3 of FIG. 1.
Figure 4:
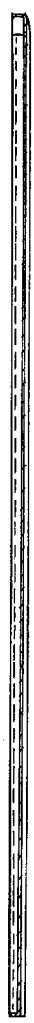
FIG. 4 is a cross-sectional view of the preferred fence panel taken along lines 4—4 of FIG. 1.
Figure 5:
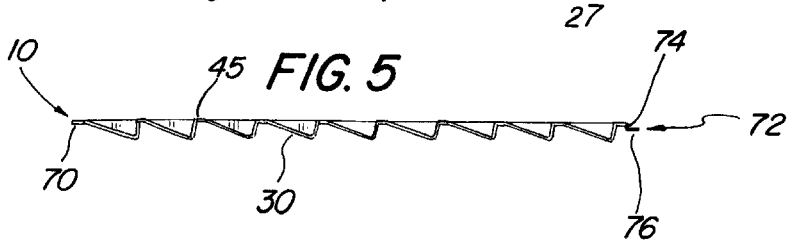
FIG. 5 is a cross-sectional view of the preferred fence panel taken along lines 5—5 of FIG. 1.

For example, FIGS. 3 and 4 are vertical cross-sectional views taken along different points of the X-axis of the panel 10 shown in FIG. 1. It will be noted that the profiles are dissimilar. Likewise, FIGS. 5 and 6, which are horizontal cross-sectional views taken along different points along the Y-axis of the panel 10 shown in FIG. 1, also illustrate different profiles. In FIGS. 5 and 6, it will be noted that a relatively narrow flat section 45 is provided between each stake 30.

A laminate or other finishing layer 67 may be disposed on both the front surface 21 and rear surface 23 for aesthetics. Alternatively, it may be preferable and cost efficient to provide the finishing layer on the front surface 21 only. The finishing layer 67 may include three-dimensional texture for a more aesthetically pleasing appearance.

The panel 10 further comprises side portions 70, 72 adapted to overlap with each other, as best shown in FIGS. 5 and 6. A first side portion 70 preferably comprises a flat, vertical flange. The opposite, second side portion 72 includes a forwardly extending flange 74 that connects to a laterally extending flange 76. The laterally extending flange 76 is therefore configured to overlap and cover the front surface of a side portion of an adjacent panel, as will be described below in connection with a preferred fencing assembly.

Figure 7:
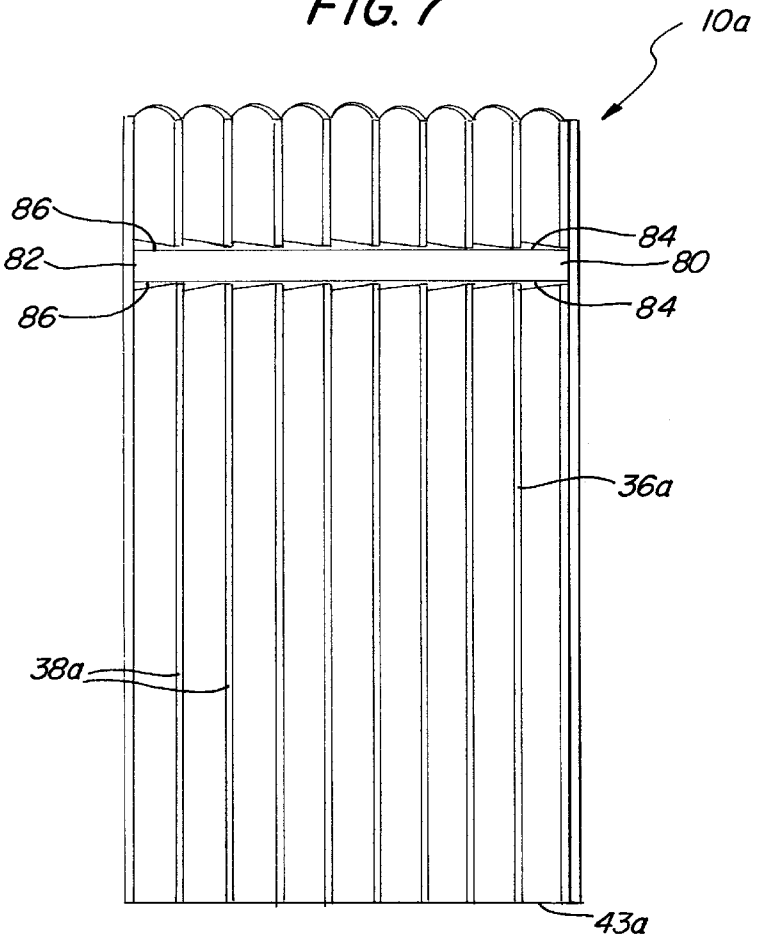
FIG. 7 is a front elevation view of a further preferred embodiment of a fence panel according to the invention.

FIG. 7 illustrates a further preferred embodiment of a fencing panel 10*a* wherein structural elements similar to those previously discussed are designated by the same reference numeral followed by the letter "a". The panel 10*a* is thermoformed to include an integral rail 80. It is to be understood that more rails may be provided. Each rail 80 comprises an outward rectangular flat portion 82 coupled to the rest of the panel 10*a* by a pair of outwardly extending flanges 84. Along with the top returns 41 and the bottom flanges 43*a*, the forwardly projecting rail 80 reinforces the rigidity of the panel 10 by preventing buckling along the vertical ridges 36*a* and creases 38*a*. Likewise, the vertical ridges 36*a* and creases 38*a* prevent buckling along the horizontal creases 86 of the rail 80.

Figure 8:
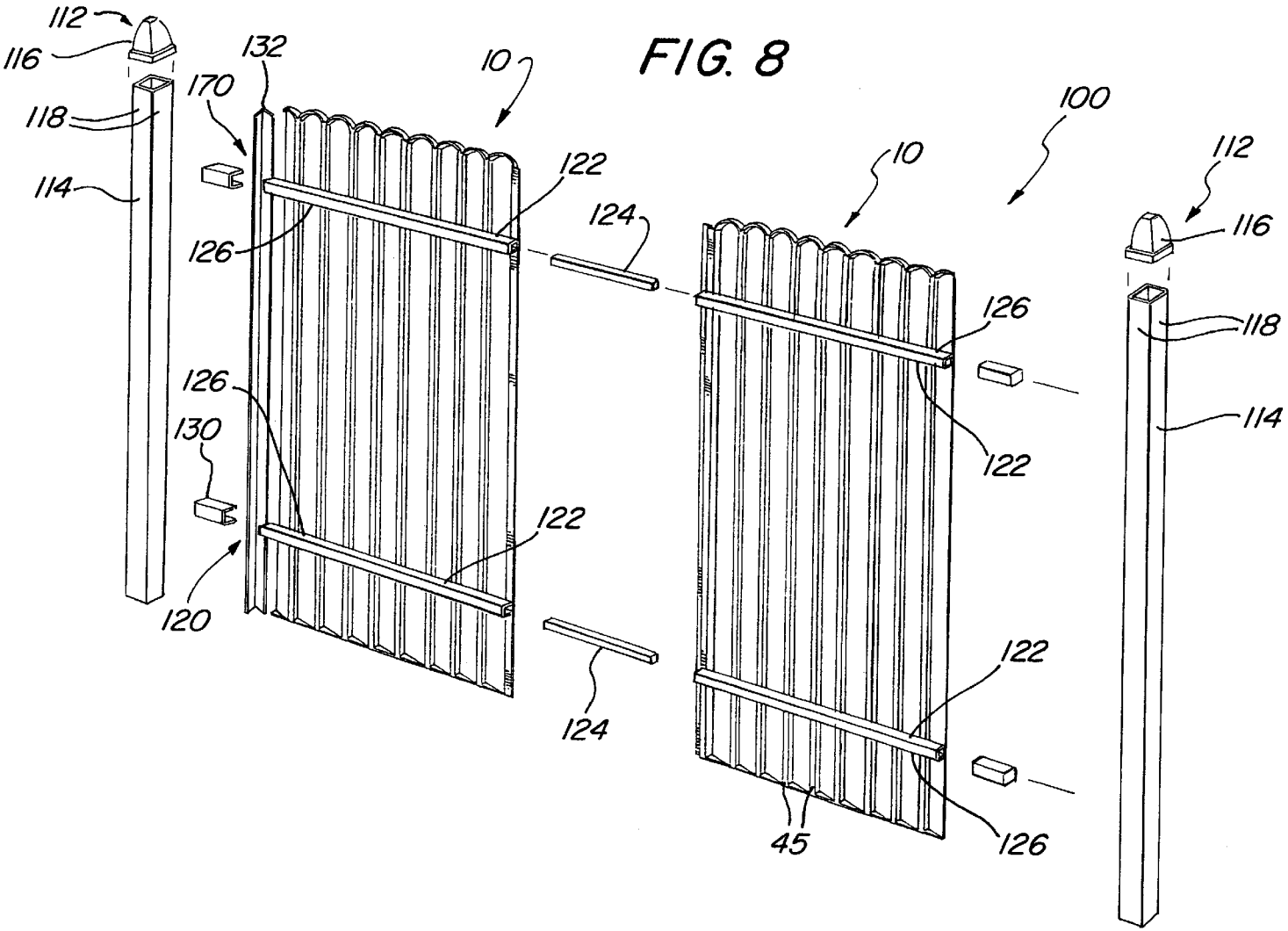
FIG. 8 is a rear exploded, perspective view of a preferred embodiment of a fencing assembly.
Figure 9:
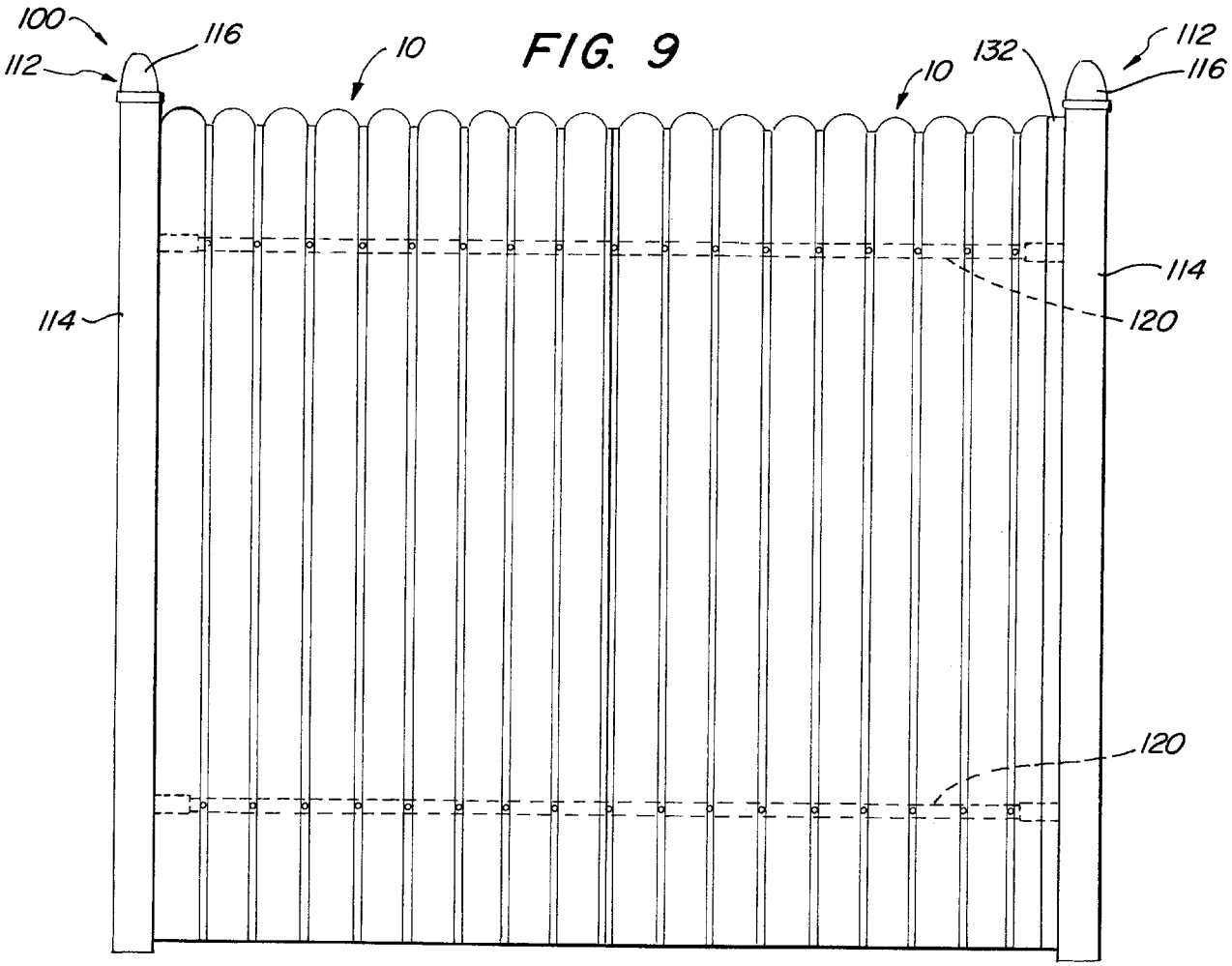
FIG. 9 is a front elevation view of the preferred embodiment of the fencing assembly.
Figure 10:
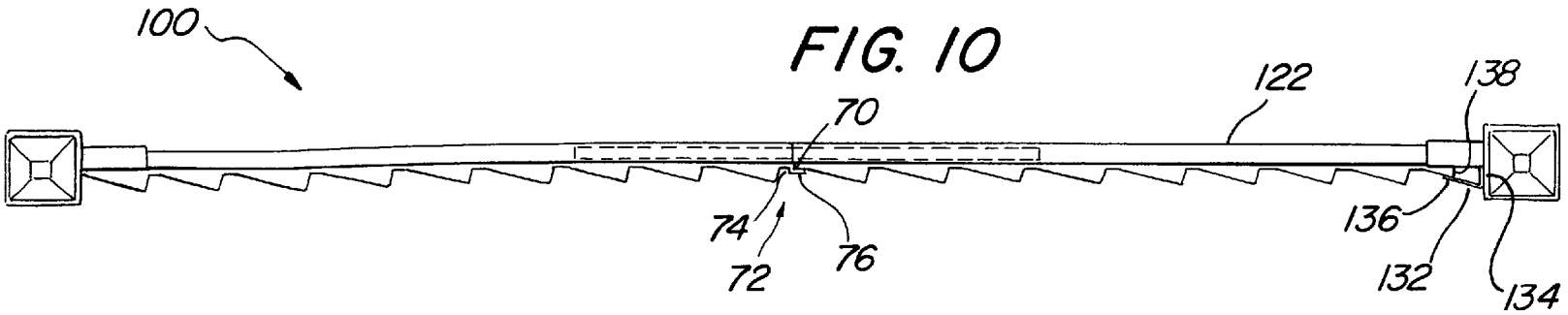
FIG. 10 is a top plan view of the preferred embodiment of the fencing assembly.

In FIGS. 8–10, a preferred embodiment of a fencing assembly 100 incorporates a plurality of the preferred fence panels 10 as described above. As an example and not by way of limitation, two panels 10 are disposed between a pair of posts 112 although more or less panels 10 may be provided between a pair of posts 112. The posts 112 preferably comprise a hollow tube 114 topped with an ornamental cap 116. The tube 114 preferably comprises a rectangular cross-section and thus includes four sides 118. The tube 114 is preferably extruded while the cap 116 is preferably injection molded.

To give the appearance of a unitary, continuous fence, the two fence panels 10 are placed side-by-side and disposed in a slightly overlapping relationship. In particular, a side portion 72 of the first panel 10 overlaps and covers the front surface of an adjacent side portion 70 of the second panel 10. As best shown in the top plan view of FIG. 10, the covering side portion 72 includes the forwardly extending flange 74 and laterally extending flange 76 as described above. The covered side portion 70 comprises a flat vertical section that is nested in the area defined by the adjacent flanges 74, 76. It will be noted that the forwardly extending flange and laterally extending flange (not shown) has been removed from the panel 10 comprising the covered side portion 70.

One or more horizontal reinforcements 120 may be provided. In the preferred embodiment, top and bottom reinforcements 120 are provided. Each reinforcement 120 preferably comprises a pair of thermoplastic hollow bars 122, each bar 122 being coupled to its corresponding fence panel 10 on the rear surface 23 preferably by adhesion. In the preferred embodiment, the bars 122 are preferably rectangular so as to provide a flat surface that abuts the flat sections 45 of the panels 10. The bars 122 are preferably composed of a thermoplastic material and may be adhered to the panels 10 with adhesive material, such as polyvinyl chloride cement. The bars 122 are aligned to receive an insert 124 which is then fastened to the pair of bars 122. Outer end portions 126 of the bars are coupled to the posts 112, preferably by brackets 130. Vertical supports (not shown) may be optionally disposed in the stake recesses 65 adjacent to the rear creases 61. In the preferred embodiment, the posts 112 and reinforcement bars 122 are composed of a thermoplastic material, such as polyvinyl chloride.

To allow for adjustability in the width of the fence assembly 100, a side cover 132 is provided and configured to resemble a stake. The side cover 132, which is preferably composed of the same thermoplastic material as the panels 10, comprises a first flat portion 134 adapted to be coupled to the post 112 and disposed between the post 112 and the narrowed panel 10. A second, slanted portion 136 extends from the first flat portion 134.

In a preferred method of assembly, an unwanted portion of a fence panel 10 may be removed prior to being joined to a post 112, thereby yielding a side edge 138 which may be unsightly. Accordingly, the corresponding reinforcement bars 122 of the narrowed panel 10 must be shortened. The side cover 132 is coupled to the post 112. The narrowed panel 10 is then coupled to the post 112. As a result, the slanted portion 136 overlaps a side portion of the narrowed panel 10 and gives the continuous appearance of another stake while covering the rough side edge 138 from frontal view.

Figure 11:
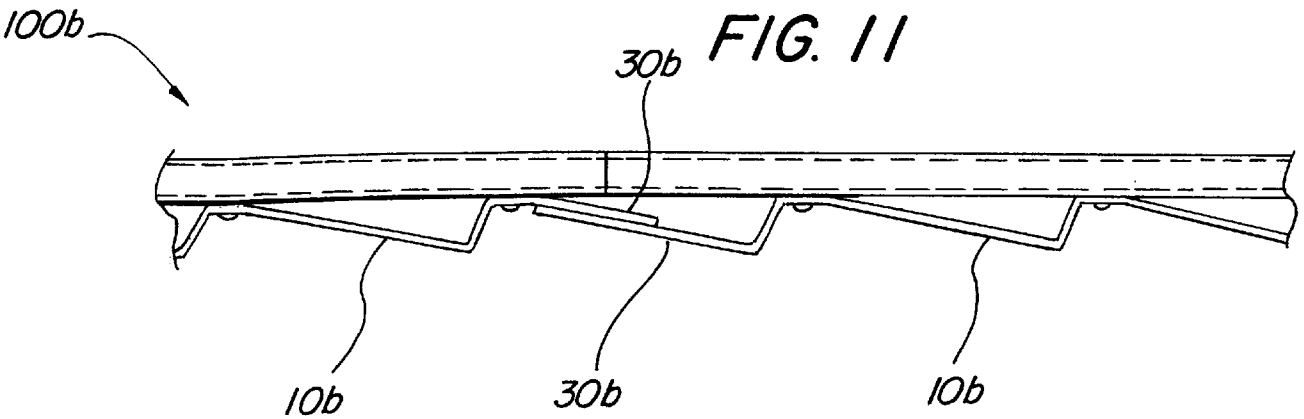
FIG. 11 is a top plan view, in part, of a further preferred embodiment of a fencing assembly.
Figure 12:
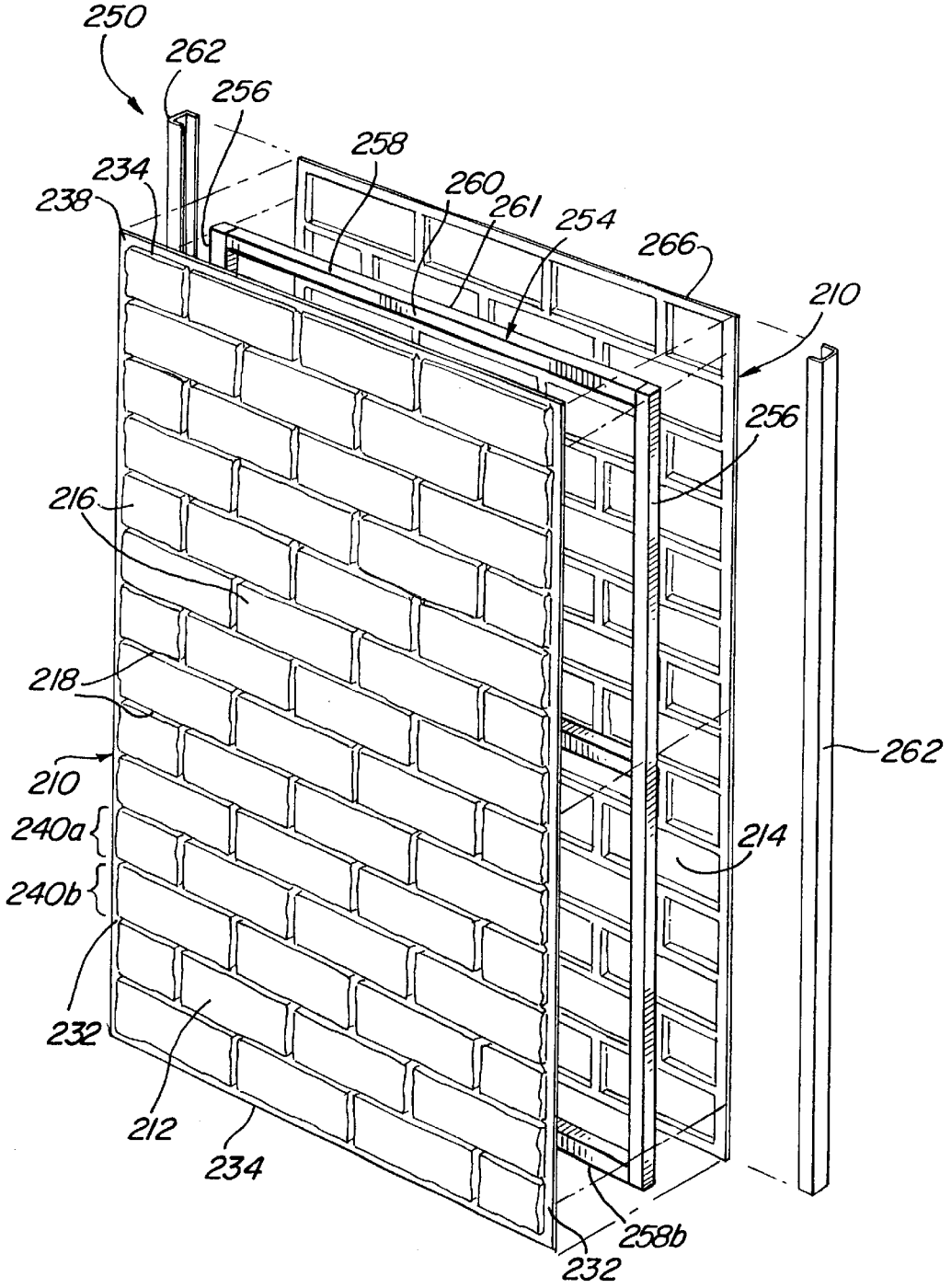
FIG. 12 is an exploded perspective view of a preferred embodiment of a double-sided wall sub-assembly according to the invention.

FIG. 11 is a top plan view, in part, of another preferred embodiment of a fence assembly 100*b* wherein structural elements similar to those previously discussed are designated by the same reference numeral followed by the letter "b". The fence assembly 100*b* incorporates a further preferred embodiment of a fence panel 10*b* wherein the flat side flanges 70, 74, 76 shown in FIGS. 1, 3 and 4 have been omitted. As a result, two panels 10*b* may be placed side-by-side and disposed in an overlapping relationship by having an outer stake 30*b*, or a portion thereof, of one panel 10*b* nest within the outer stake 30*b* of the other, adjacent panel 10*b*.

In the above illustrated embodiments, the fence assembly is shown as having two panels 10 disposed in between a pair or posts 112. An expanded fence assembly may be provided by coupling additional panels to any of the unattached sides of the posts 112 and adding further posts. Since the posts 112 preferably comprise a tube with a rectangular profile having four sides, it will be appreciated that additional panels may be coupled to any of the unused sides to form perpendicular fence sections which may be preferable in fencing off areas of land. The tube 114, however, may be formed in a variety of polygonal profiles, thereby varying the number of sides available for coupling to additional panels. For example, a post may comprise a hexagonal tube 114 which would then provide six surfaces to which fence panels may be coupled. This may give a user greater flexibility, for example, in bordering corners of land that are not right angles. The tubes 114 of the posts 112 according to the invention are formed with a thickness preferably about 0.125 inch.

It will be appreciated that an elongated fencing assembly may be formed with a plurality of the fence sections 10 according to the invention. With increasing needs for environmental preservation, an inexpensive alternative is provided for wood fencing which is just as aesthetically pleasing and even longer lasting. Furthermore, unlike conventional plastic fences in which each individual stake is extruded, the fencing section 10 according to the invention is much less expensive since a plurality of stakes may be formed in a single, integral panel. Since the panel 10 is thermoformed, three-dimensional features, such as the top flanges 43, bottom flange 45, and the corrugation of the stakes 30, collectively give the panel 10 an impression of depth and volume when, in fact, the thickness of the panel is, for example, only)0.06 inch in the preferred embodiment.

In the preferred embodiments, the wall panels comprise solid sheets without holes or openings. As fencing assemblies, this feature of the wall panel provides greater privacy than conventional fences. It is to be expressly understood, however, that apertures may be formed in the panels if desired. In the fence panel 10 shown in FIGS. 1–6, apertures may be formed, for example, by removing portions of the minority portion 34 of the stakes 30.

In another aspect, a double-sided wall assembly according to the invention may be provided with wall panels thermoformed to resemble a variety of different wall structures. In FIGS. 12–15, a preferred embodiment of a double-sided wall assembly incorporating thermoformed panels is illustrated and designated generally by the reference numeral 200. As described above, thermoforming enables panels to be formed with discontinuous structural features that are impossible to achieve by extrusion. In FIGS. 12–15, the wall assembly 200 includes panels 210 thermoformed to resemble a brick wall section. It is to be understood that a variety of masonry patterns may be formed.

Each panel 210 comprises a front surface 212 and a rear surface 214. A plurality of forwardly protruding "bricks" 216 are formed with recessed "grout lines" 218 horizontally and vertically dividing the bricks 216. The rearwardly protruding grout lines 218 correspond to flat rear surfaces which provide surface area for abutting a frame as described further below. A border 230 of the panel 210 comprises flat side flanges 232 and flat top and bottom flanges 234. The outwardly raised front surface 212 may include finer three-dimensional texture, such as asymmetrical bumps and grooves, to give a more realistic and aesthetically pleasing appearance of bricks. For example, the preferred embodiment includes a Slumpstone texture. Other textures may be employed.

For ease of manufacturability, the wall panel 210 may simply comprise two alternating rows 240*a*, 240*b* of differing structure. More or less rows of differing structure may be provided. In the embodiment illustrated in FIG. 12, a Running Bond pattern of bricks is configured. It is to be expressly that a variety of different patterns may be thermoformed into the panel, such as basket weave, herringbone, stack bond, stone, rock, and more.

Figure 13:
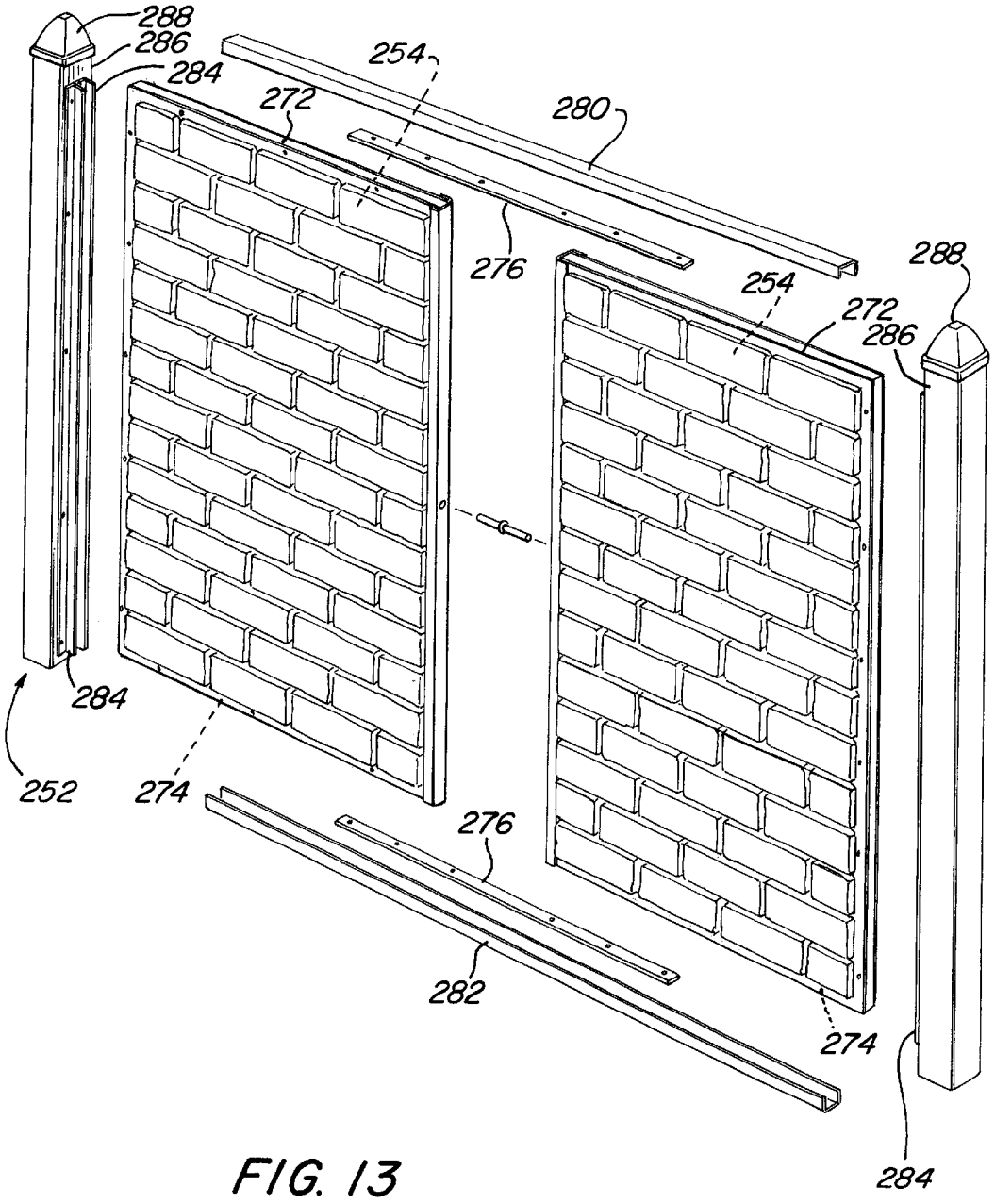
FIG. 13 is a partially exploded front view of the preferred embodiment of the wall structure.
Figure 14:
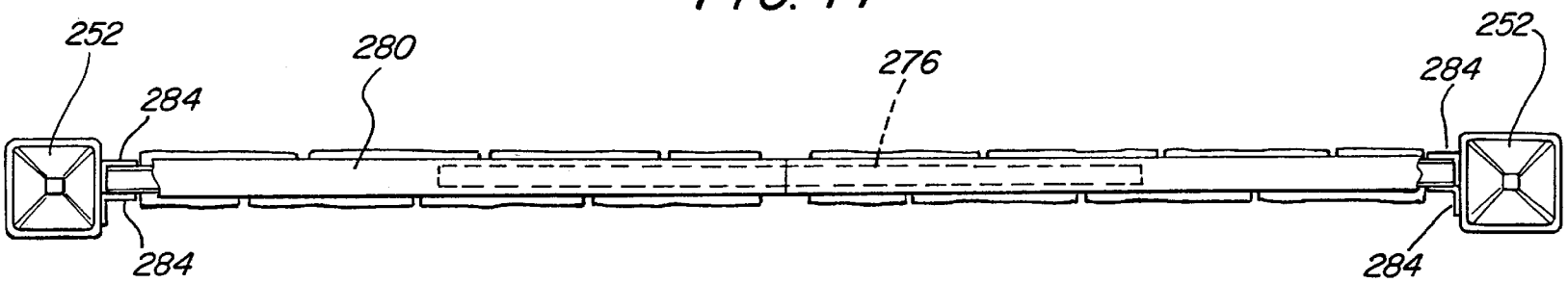
FIG. 14 is a top plan view of the preferred embodiment of the wall structure in part.

In the preferred embodiment shown in FIG. 13, the wall assembly 200 includes two panel sub-assemblies, or double-sided wall structures, 250 disposed side-by-side in between a pair of posts 252. More or less panel sub-assemblies may be provided between a pair of posts 252. Each panel assembly 250 includes a frame, or skeleton, 254 which comprises a plurality of vertical bars 256 and horizontal bars 258. The frame defines opposite sides 260, 261. A pair of panels 210 are coupled to the opposite sides 260, 261 of the frame 254, such as with fasteners, in a back-to-back arrangement with the rear surfaces 214 facing each other. Accordingly, the front surfaces 212 of the pair of panels 210 face outwardly and away from each other.

Side covers 262, each defining a U-channel, are coupled to the sides 262 of each panel sub-assembly 250. The panel sub-assemblies 250 are coupled to each in a side-by-side arrangement. In the preferred embodiment, a top horizontal bar 258 of the frame 254 is offset from and disposed beneath top edges 266 of the panels 210. A bottom horizontal bar 258 is also offset from and disposed above the bottom edges 270 of the panels 210. Accordingly, top and bottom spaces 272, 274, respectively, are provided for receiving reinforcing members, or support bars, 276 which may be composed of metal, for example. In the preferred embodiment, a top reinforcing member 276 is disposed in the top space 272 bridging the two panel assemblies 250. Similarly, a bottom reinforcing member 276 is disposed in the bottom space 274. The reinforcing members 276 are coupled to the frame 254. Thus, each reinforcing member 276 is juxtaposed in an overlapping relationship with both frames 254. A dowel, or pin, 277 couples the two sub-assemblies 250 together. The pin 277 is inserted through the side covers 262 and the vertical bars 256 of the frames 254. A clip 299 fixed over the pin 277 keeps the pin 277 stationary by preventing any lateral movement between the sub-assemblies 250.

A single top end cover and bottom end cover 280, 282, respectively, are preferably disposed across both panel sub-assemblies 250. The top and bottom end covers 280, 282 define U-channels. With the spaces 272, 274 provided by the offset horizontal frame bars 264, 268, respectively, it will be appreciated that the reinforcement members 276 received therein may be substantially flush with the top edges 266 and bottom edges 270 of the panels 210.

In the preferred embodiment, a pair of L-flanges, or brackets, 284 are coupled to each post 252 so as to define a slot 286 for receiving the panel sub-assemblies 250. A variety of mechanisms may be employed to couple the panel sub-assemblies 250 to the posts 252. The posts 252 preferably comprise a hollow tube 286 topped with an ornamental cap 288.

It will be appreciated that an elongated wall structure may be formed by providing additional panel sub-assemblies and posts and coupling such additional structures to the wall structure 200.

Figure 15:
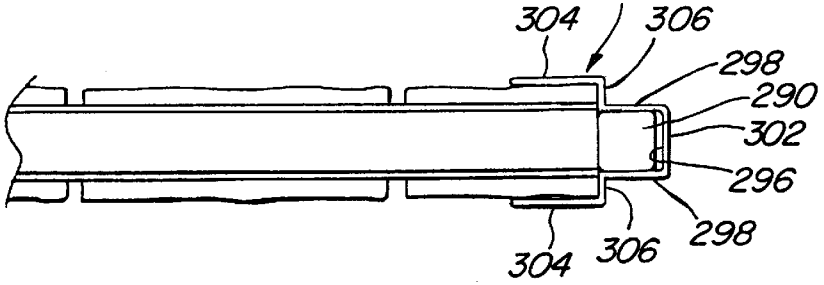
FIG. 15 is a top plan view, in part, of the preferred embodiment of the wall structure incorporating a side cover.

The wall assembly 200 also provides adjustability in width as shown in FIG. 15. For example, a user may desire a specific width between the pair of posts 252 that is different from the width provided by pre-manufactured panels 210. In such a case, an unwanted portion (not shown) of a panel sub-assembly 250 may be removed so as to provide the desired width. For example, by making a vertical cut, an unwanted side portion of a panel sub-assembly 250, including portions of the frame and opposing side panels, may be removed to leave the remainder of the panel assembly 250 with the desired width. A vertical frame bar, or vertical support, 290 may be coupled to the edge 292 from which the unwanted portion has been removed. To maintain a continuous and aesthetically pleasing appearance, a side cover 294 according to the invention is coupled to the panel assembly 250. The side cover 294 includes a central recess, or central U-channel, 296 defined by a pair of central flanges 298 joined by a middle flange 302. The U-channel is configured to receive and cover the projecting vertical frame bar 290 that has been added. Outer flanges 304 are configured to cover the unsightly edges 292 of the cut panels 210. The outer flanges 304 are joined by connecting flanges 306 to the central flanges 298. The side cover 294 is also configured to fit within the slot 286 defined by the L-flanges 284.

With the side cover 294 coupled to the reduced panel sub-assembly 250, the sub-assembly 250 may then be coupled to the post 252 by inserting the side cover 294, namely the central U-channel, into the slot 286. In the preferred embodiment of the wall assembly 200, the panels 210, posts 252, covers 262, 280, 282, 294 are composed of a thermoplastic material, such as polyvinyl chloride.

It will be appreciated that the double-sided wall assembly 200 according to the invention may incorporate wall panels thermoformed in a variety of designs. For example, a wall panel may be thermoformed to resemble a brick wall with an uneven array of bricks. In particular, each brick may be configured to be outwardly or inwardly disposed relative to adjacent bricks so as to form an uneven pattern. As further examples, the wall panel may be thermoformed to resemble other masonry patterns.

The above embodiments may be erected in open space to serve as a fence around an open piece of property. The unique heat dissipation characteristic of the thermoformed panels according to the invention also enable a variety of dark colors to be applied. The panels according to the invention comprise unitary sheets without cavities. Since no pockets exist in which absorbed heat can build up, the heat absorbed by the panels simply dissipates into the ambient environment. With the excellent heat dissipating qualities of the panels due to the lack of cavities, it will be appreciated that the fencing and wall assemblies according to the invention may be painted a variety of dark colors, such as redwood brown, to resemble a natural wood fence or siding. Furthermore, the posts may optionally include solid inserts, such as wood studs, disposed in the cavity in order to prevent the tube from warping.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what incorporates the essential idea of the invention.

What is claimed is:

1. A fence assembly comprising:

an integral thermoformed panel comprising:

a top;

a bottom;

a first axis defined between the top and the bottom;

a front surface;

a rear surface; and a plurality of stakes, each stake extending parallel to the first axis and having a top return extending perpendicular to the first axis, each stake including a majority section and a minority section that meet at a front vertical ridge;

a reinforcement coupled to the panel; and a post coupled to the panel.

2. The assembly of claim 1, wherein each top return comprises a rounded shape.

3. The assembly of claim 1, further comprising a side cover coupled to a side portion of the panel.

4. The assembly of claim 1, further comprising a bottom flange.

5. The assembly of claim 1, wherein the reinforcement comprises a hollow bar and a solid insert disposed within the bar.

6. The assembly of claim 1, further comprising a flat vertical portion disposed between each stake, wherein the reinforcement is welded to the flat vertical portions.

7. The assembly of claim 1, further comprising a pair of brackets coupling the thermoformed panel to the post.

8. The assembly of claim 1, wherein each stake is integral with an adjacent stake such that no gaps are formed therebetween.

9. The fence assembly of claim 1, wherein each stake further comprises a nestable side portion.

10. A fence assembly, comprising:

a first post;

a second post;

a first integral thermoformed panel having a first plurality of vertically extending stakes with top returns, and a first side portion; and a second integral thermoformed panel having a second plurality of vertically extending stakes with top returns, and a second side portion configured to overlap the first side portion of the first thermoformed panel;

wherein the first thermoformed panel is disposed side-by-side with the second thermoformed panel such that the second side portion overlaps the first side portion, and wherein the first thermoformed panel and the second thermoformed panel are disposed in between the posts, the first thermoformed panel being coupled to the first post, and the second thermoformed panel being coupled to the second post, and wherein each stake of the first plurality of vertically extending stakes and the second plurality of vertically extending stakes includes a front surface, a rear surface, a majority section and a minority section that meet at a front vertical ridge.

11. The assembly in claim 10, further comprising horizontal reinforcements coupled to the panels.

12. The assembly of claim 11, wherein each of the reinforcements comprises a hollow bar and a solid insert disposed within the bar.

13. The assembly of claim 11, wherein each of the first and second thermoformed panels further comprises a flat vertical portion disposed between each stake.

14. The assembly of claim 10, wherein:

the first side portion comprises a first laterally extending flange;

the second side portion comprises a forwardly extending flange connected to a second laterally extending flange.

15. The fence assembly of claim 10, wherein:

each of the first and second thermoformed panels further comprises:

a top, a bottom, a first axis defined between the top and the bottom, each stake extending parallel to the first axis and having a top return extending perpendicular to the first axis, and each of the first and second side portions is a nestable side portion.

16. The assembly of claim 15, wherein each top return comprises a rounded shape.

17. The assembly of claim 15, wherein:

the first thermoformed panel has a second side portion opposite the first side portion;

the second thermoformed panel has a first side portion opposite the second side portion of the second thermoformed panel; and the assembly further comprises a side cover coupled to the side portion of one of the first and second thermoformed panels.

18. The assembly of claim 15, wherein each of the first and second thermoformed panels further comprises a bottom flange.

19. The assembly of claim 10, further comprising:

a first pair of brackets coupling the first thermoformed panel to the first post; and a second pair of brackets coupling the second thermoformed panel to the second post.

20. The assembly of claim 10, wherein:

each stake of the first panel is integral with an adjacent stake of the first panel such that no gaps are formed therebetween; and each stake of the second panel is integral with an adjacent stake of the second panel such that no gaps are formed therebetween.

* * * * *